United States Patent [19]

Chidsey, Jr.

[11] 4,253,565

[45] Mar. 3, 1981

[54] CARRIER PARTITION ARRANGEMENT

[75] Inventor: Francis A. Chidsey, Jr., Devon, Pa.

[73] Assignee: Container Corporation of America, Chicago, Ill.

[21] Appl. No.: 112,949

[22] Filed: Jan. 17, 1980

[51] Int. Cl.[3] ..... B65D 85/30; B65D 5/48

[52] U.S. Cl. ..... 206/190; 229/28 BC; 206/193

[58] Field of Search ..... 229/28 BC, 52 BC; 206/181, 190, 191, 193

[56] References Cited

U.S. PATENT DOCUMENTS

| | | | |
|---|---|---|---|
| 2,692,701 | 10/1954 | Lighter | 206/190 |
| 2,712,882 | 7/1955 | Battery et al. | 229/28 BC X |
| 2,860,816 | 11/1958 | Fielding | 206/190 X |
| 3,211,357 | 10/1965 | Weiss | 229/28 BC |
| 3,337,043 | 8/1967 | Parker | 206/193 X |

FOREIGN PATENT DOCUMENTS

| | | | |
|---|---|---|---|
| 2537881 | 3/1977 | Fed. Rep. of Germany | 229/26 BC |
| 91724 | 6/1968 | France | 206/193 |

*Primary Examiner*—Davis T. Moorhead
*Attorney, Agent, or Firm*—Richard W. Carpenter

[57] ABSTRACT

A bottle carrier carton partition arrangement having a pair of partition elements with overlapping portions to provide a two-ply thickness between adjacent bottles.

4 Claims, 3 Drawing Figures

CARRIER PARTITION ARRANGEMENT

SUMMARY OF THE INVENTION

This invention relates to partition structures for paperboard carrier cartons of the type used to enclose a plurality of bottles arranged in side-by-side relation.

In order to prevent breakage of bottles in carrier packages of this type, it is necessary to provide partitions between adjacent bottles. Transportation regulations provide minimum thickness requirements for such partitions.

It is an object of this invention to reduce the cost of packages of this type by providing a partition structure having a thickness, at the critical area of contact between adjacent packaged bottles, which is twice as great as the thickness of the material used to form the package.

These and other objects of the invention will be apparent from an examination of the following description and drawings.

THE DRAWINGS

DESCRIPTION OF THE INVENTION

Figure 1:
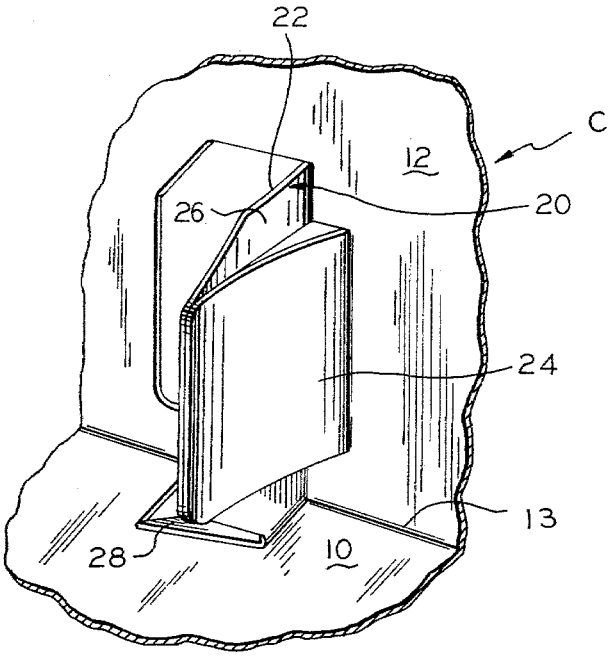
FIG. 1 is a fragmentary perspective of a carrier carton partition structure embodying features of the invention.
Figure 3:
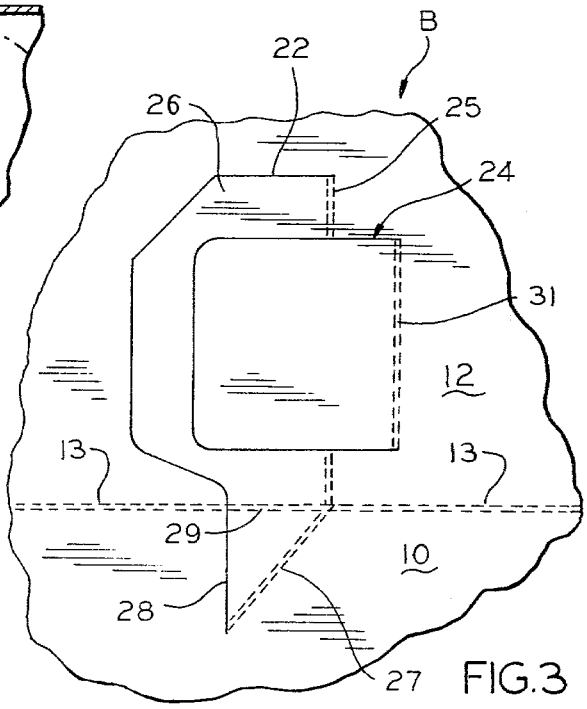
FIG. 3 is a fragmentary plan view of a portion of the blank of sheet material from which the carrier carton partition structure of the other views may be formed.

Referring now to the drawings for a better understanding of the invention, it will be seen that the novel partition structure embodying features of the invention is shown in a carrier indicated generally at C in FIG. 1 and may be formed from a blank B of of foldable sheet material partially illustrated in FIG. 3.

The carrier is adapted to hold the plurality of fragile articles, such as bottles arranged in a side-by-side relationship.

Inasmuch as the invention is concerned only with the individual partition structures, the drawings do not illustrate a complete package which may be of conventional design having bottom, side and end walls with a central longitudinal vertical partition wall.

As best seen in FIG. 1, the structure includes a bottom wall 10 and a vertical wall 12 foldably joined at its lower edge along fold line 13 to the bottom wall and upstanding therefrom.

Vertical wall 12 is preferably a longitudinal center partition wall but also may be, if desired, a side wall of the carton.

Each of the partition structures 20 includes a pair of cooperating first and second partition members 22 and 24, respectively.

Each of the partition members are formed from material cut from the bottom and/or vertical walls with part of the second partition member 24 being formed from material which, in turn, is cut from first partition member 22.

As best seen in FIGS. 1 and 3, first partition member 22 includes a vertical element 26 which is foldably joined at one edge along an interrupted fold line 25 to vertical wall 12 and a horizontal element 28 which is foldably joined at one edge to the bottom wall on a fold line 27 which extends diagonally from fold line 13 and which is foldably joined at another edge along fold line 29 to the lower edge of vertical element 26.

Second partition member 24 comprises a single panel, which as best seen in FIG. 3, is formed partly from material of the first partition member 22. Second partition member 24 is also joined at one edge to vertical wall 12 along a fold line 31 which is located parallel to be spaced laterally from fold line 25.

Figure 2:
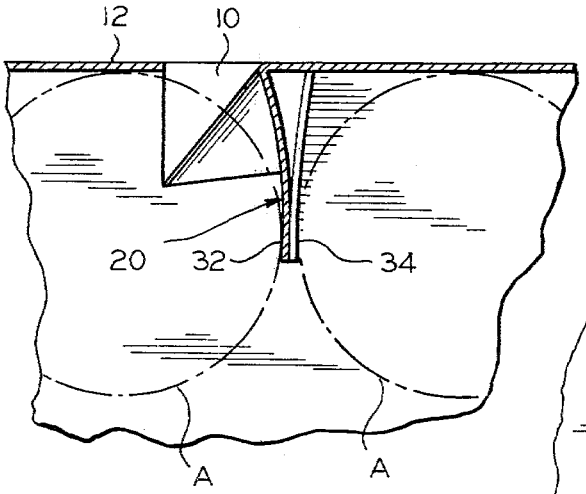
FIG. 2 is a plan view of the structure illustrated in FIG. 1.

When the partition structure is erected, as shown in FIGS. 1 and 2, it will be seen that the vertical element 26 of the first partition member 22 is folded inwardly from the plane of the vertical wall 12 and substantially normal to the bottom wall and to the horizontal element 28 which is disposed in face to face relation with the bottom wall 10.

Second partition member 24 is also folded inwardly from the plane of vertical wall 12. Thus, when the two partition members are folded inwardly, approximately normal to the plane of the vertical wall 12, the end portions 32 and 34 of the first and second members 22 and 24, respectively, abut each other in face-to-face relation to the critical area of contact between a pair of adjacent packaged bottles. Thus, a two ply thickness in the partition structure is provided in the area of contact by the novel partition arrangement. The partition members may be either folded inwardly at angles at slightly less than 90 degrees from the vertical or they may be bowed or curved to accomplish this objective.

I claim:

1. A partition arrangement for a carrier carton formed of foldable sheet material, such as paperboard or the like, for enclosing a plurality of bottles disposed in side-by-side relation, comprising;

(a) a bottom wall;

(b) at last one vertical wall foldably joined to and upstanding from said bottom wall;

(c) a partition structure formed from material of said vertical wall and said bottom wall, including:

(i) a first member having a vertical element foldably joined at an end edge to said vertical wall on a first fold line, and a horizontal element foldably joined at one edge to said bottom wall, foldably joined at another edge to a lower edge of said vertical element, and disposed in face-to-face relation with said bottom wall;

(ii) a second member foldably joined at an end edge to said vertical wall on a second fold line located parallel to but spaced laterally from said first fold line;

(iii) said second member being formed from material of said first member and other material of said vertical wall;

(iv) said members being folded out of the plane of said vertical wall with their respective end portions positioned in face-to-face relation with each other between a pair of adjacent bottles to provide a partition structure of two-ply thickness.

2. A partition arrangement for a carrier carton formed of foldable sheet material, such as paperboard or the like, for enclosing a plurality of bottles disposed in side-by-side relation; comprising;

(a) a bottom wall;

(b) at least one vertical wall upstanding from said bottom wall;

(c) a partition structure formed from material of said vertical wall, including:

(i) a first member foldably joined at an end edge to said vertical wall on a first fold line;

(ii) a second member foldably joined at an end edge to said vertical wall on a second fold line located parallel to but spaced laterally from said first fold line;

(iii) said second member being formed from material of said first member and other material of said vertical wall;

(iv) said members being folded out of the plane of said vertical wall with their respective end portions positioned in face-to-face relation with each other between a pair of adjacent bottles to provide a partition structure of two-ply thickness.

3. A partition arrangement according to claim 2, wherein said partition members are folded into converging relation from said vertical wall.

4. A partition arrangement according to claim 2, wherein said partition members are bowed inwardly toward each other.

* * * * *